US005105786A

United States Patent [19]

Kato

[11] Patent Number: 5,105,786

[45] Date of Patent: Apr. 21, 1992

[54] FUEL INJECTION PUMP OF DISTRIBUTION TYPE

[75] Inventor: Hiroaki Kato, Saitama, Japan

[73] Assignee: Zexel Corporation, Tokyo, Japan

[21] Appl. No.: 733,615

[22] Filed: Jul. 22, 1991

[30] Foreign Application Priority Data

Aug. 8, 1990 [JP] Japan ..... 2-208194

[51] Int. Cl.[5] ..... F02M 39/00

[52] U.S. Cl. ..... 123/449; 123/370; 123/502

[58] Field of Search ..... 123/449, 503, 502, 506, 123/370, 371, 373

[56] References Cited

U.S. PATENT DOCUMENTS 4,368,706 1/1983 Yasuhara ..... 123/370
4,392,469 7/1983 Wessel ..... 123/449
4,397,280 8/1983 Yasuhara ..... 123/373
4,483,297 11/1984 Eheim ..... 123/449
4,548,184 10/1985 Laufer ..... 123/449
4,924,833 5/1990 Hofer ..... 123/449

*Primary Examiner*—Carl Stuart Miller

[57] ABSTRACT

A fuel injection pump of the distribution type includes a load timer, and the load timer has a relief hole formed axially in a governor shaft, a first communication passage extending through a peripheral wall of the governor shaft surrounding the relief hole, and a second communication passage extending through a peripheral wall of a governor sleeve. One of the first and second communication passages has first and second control holes spaced axially from each other. The stroke of movement of the governor sleeve has a first movement region where the area of communication between the first control hole and the other communication passage decreases as the governor sleeve is retracted and a second movement region where the area of communication between the second control hole and the other communication passage increases as the governor sleeve is retracted.

12 Claims, 8 Drawing Sheets

FUEL INJECTION PUMP OF DISTRIBUTION TYPE

BACKGROUND OF THE INVENTION

This invention relates generally to a fuel injection pump of the distribution type, and more particularly to an improved load timer for adjusting the fuel injection timing in accordance with the load of an engine.

Japanese Laid-Open (Kokai) Patent Application No. 119132/82 discloses a fuel injection pump of the distribution type. This fuel injection pump is provided with a housing 2 whose internal space serves as a pump chamber. A drive shaft 6 to which the rotation of an engine is transmitted extends into the housing 2. One end portion of the drive shaft 6 disposed within the pump chamber is connected to one end of a plunger 5 through a coupling so as to rotate the plunger 5 in a manner to allow an axial movement of the plunger 5. The other end of the plunger 5 cooperates with the housing to form a fuel pressurizing chamber 14. The rotational movement of the plunger 5 serves to distribute the fuel in the fuel pressurizing chamber sequentially to a plurality of injection nozzles. Cam mechanisms 7 and 8 for reciprocally moving the plunger 5 axially in response to the rotational movement of the plunger 5 are provided within the pump chamber. When the plunger 5 moves in one direction (that is, at a suction stroke), it draws the fuel into the fuel pressurizing chamber 14, and when the plunger 5 moves in the other direction (that is, at a pumping stroke), it pressurizes the fuel in the fuel pressurizing chamber 14.

A control sleeve 19 is axially slidably mounted on the outer periphery of the plunger 5. A cut-off port 31 in the plunger 5 is closed by the control sleeve 19 during the pumping stroke, and when the cut-off port 31 moves away from the control sleeve 19, the pressurized fuel in the fuel pressurizing chamber 14 escapes to the pump chamber via the cut-off port 31, thus finishing the fuel injection. The position of the control sleeve 19 determines the amount of injectin of the fuel. A lever assembly is pivotally supported within the housing 2. The position of the control sleeve 19 and hence the fuel injection amount are adjusted by this lever assembly. A governor spring 41 for receiving an operating force of an accelerator pedal is accommodated within the housing 2. The governor spring 41 urges the lever assembly to be pivotally moved so as to move the control sleeve 19 in the direction of the pumping stroke of the plunger 5, that is, so as to increase the fuel injection amount. A governor is also received within the housing 2. This governor urges the lever assembly to be pivotatlly moved so as to move the control sleeve 19 in the direction of the suction stroke of the plunger 5, that is, so as to decrease the fuel injection amount. This governor comprises a governor shaft 45 fixedly mounted on the housing 2 and extending into the pump chamber, a governor sleeve 37 axially slidably mounted on the outer periphery of the governor shaft 45, a rotation member 46 mounted on the governor shaft 45 so as to be rotated by the rotation of the drive shaft 6, and fly weights 47 supported on the rotation member 46. Under the infuence of the centrifugal force of the fly weight 47 caused by the rotation of the rotation member 46, the governor sleeve 37 urges the lever assembly to be pivotally moved.

A main timer 39 is provided on the housing 2. The main timer 39 adjusts the above cam mechanisms 7 and 8 in accordance with the pressure in the pump chamber so as to adjust the fuel injection timing. This adjustment is made in such a manner that the higher the pressure in the pump chamber is, the earlier the fuel injection timing is.

The fuel injection pump of the above prior publication is also provided with a load timer which cooperates with the main timer 39 to adjust the fuel injection timing in accordance with the load of the engine. This load timer includes the above-mentioned governor. The load timer further includes a relief hole 49 formed in the governor shaft 45 and extending axially thereof, a first communication passage passing through the peripheral wall of the governor shaft 45 surrounding the relief hole 49, and a second communication passage passing through the peripheral wall of the governor sleeve 37. The first communication passage has a single annular groove 48 formed in the outer peripheral surface of the governor 45, and a port communicating the annular groove 48 with the relied hole 49. The second communication passage is defined by a single control hole 50 of a small cross-sectional area.

The above load timer is of a well-known contruction. In this load timer, when the engine load is low, the governor sleeve 37 is positioned forwardly, and therefore the control hole 50 is in communication with the annular groove 48, so that the pressure in the pump chamber escapes to the relief hole 49. The area of communication between the control hole 50 and the annular groove 48 is equal to the total cross-sectional area of the annular groove 48, and therefore the pressure in the pump chamber is at the minimum level, so that the fuel injection timing determined by the main timer is the latest. As the engine load increases, the governor sleeve 37 is gradually retracted, and therefore the area of communication between the control hole 50 and the annular groove 48 is gradually decreased, so that the pressure in the pump chamber increases, and therefore the fuel injection timing becomes earlier or advanced. When the engine load further increases, so that the governor sleeve 37 retracted, the control hole 50 is closed by the governor shaft 45, and therefore the pressure in the pump chamber is increased, so that the fuel injection timing becomes the earliest.

In the above known load timer, during the idling of the engine immediately after the start of the engine at cold places or high places, the fuel injection timing is late or delayed because of a low engine load, and therefore the engine may be stopped or may produce smoke. To deal with such difficulty, the fuel injection pump of the above prior publication is provided with a solenoid valve 51 for opening and closing the relief hole 49, and a control unit 52 for controlling the solenoid valve 51. The control unit 52 controls the solenoid valve 51 in accordance with information (e.g. the temperature of cooling water for the engine, the atmospheric pressure, the engine load, and so on) inputted thereto, so that the fuel injection timing can be advanced or made earlier even during a low-load operation of the engine. However, the addition of the solenoid valve 51 increases the cost involved.

Japanese Laid-Open Utility Model Application No. 12743/87 also discloses a load timer for a fuel injection pump of the distribution type. As best shown in FIG. 1 of this prior publication, two annular grooves 59 and 60 are formed in an outer periphery of a governor shaft 42, and are spaced from each other axially of the governor shaft 42, the annular grooves 59 and 60 serving as first communication passages. Two annular grooves 57 and 58 are formed in an inner periphery of a governor sleeve 41, and serve as second communication passages. When the engine load is low, the area of communication between the annular grooves 57 and 59 is large, and also the area of communication between the annular grooves 58 and 60 is large. Therefore, the fuel injection timing is late. As the engine load increases, the area of communication between the grooves 57 and 59 and the area of communication between the grooves 58 and 60 are decreased, so that the fuel injection timing is advanced. Then, when the engine load increases to a certain level, the communication between the grooves 57 and 59 is interrupted, and also the communication between the grooves 58 and 60 is interrupted, so that the fuel injection timing becomes the earliest. The pair of annular grooves are formed in each of the governor shaft 42 and the governor sleeve 41, and therefore the rate of increase of the pressure of the pump chamber (the degree of advance of the fuel injection timing) relative to the increase of the engine load (the fuel injection amount) can be twice higher than that obtained with the provision of a single first communication passage and a single second communication passage (see FIG. 2). Also, by changing the width of the annular grooves, a characteristics line, representing the degree of advance of the fuel injection timing relative to the engine load, can have two different gradients, as shown in FIGS. 4 to 6 of this prior publication.

In the load timer of the above Japanese Laid-Open Utility Model Application No. 12743/87, however, the fuel injection timing can not be advanced in a low engine load region. Further, the fuel injection timing can not be delayed in accordance with the increase of the engine load from the low engine load region.

SUMMARY OF THE INVENTION

It is an object of this invention to provide a fuel injection pump of the distribution type provided with a load timer which is designed to achieve desired characteristics of a fuel injection timing relative to an engine load in various manners.

According to the present invention, there is provided a fuel injection pump of the distribution type comprising:

(a) a housing whose internal space serves as a pump chamber;

(b) a drive shaft extending into the housing and being rotatable in response to rotation of an engine, one end of the drive shaft being disposed within the housing;

(c) a plunger disposed coaxially with the drive shaft, the drive shaft being connected at the one end thereof via a coupling to one end of the plunger so as to rotate the plunger in a manner to allow an axial movement of the plunger, the other end of the plunger cooperating with the housing to form a fuel pressurizing chamber, and the plunger having a cut-off port which is communicated with the fuel pressurizing chamber and is open to an outer peripheral surface of the plunger;

(d) a cam mechanism operable in response to the rotation of the plunger so as to cause the plunger to perform a suction stroke for drawing fuel into the fuel pressurizing chamber and to cause the plunger to perform a pumping stroke for pressurizing the fuel in the fuel pressurizing chamber;

(e) a control sleeve mounted on the outer periphery of the plunger for sliding movement therealong, the cut-off port in the plunger being closed by the control sleeve during the pumping stroke, when the cut-off port is moved away from the control sleeve, the pressurized fuel in the fuel pressurizing chamber escaping to the pump chamber, thereby finishing a fuel injection, and the position of the control sleeve determining the amount of injection of the fuel;

(f) lever means pivotally mounted within the housing so as to adjust the position of the control sleeve;

(g) a governor spring mounted within the housing so as to receive an acceleration force, the governor spring urging the lever means to be pivotally moved so as to move the control sleeve in a direction of the pumping stroke of the plunger;

(h) a governor urging the lever means to be pivotally moved so as to move the control sleeve in a direction of the suction stroke of the plunger, the governor including a governor shaft fixedly mounted on the housing and extending into the pump chamber, a governor sleeve mounted on an outer periphery of the governor shaft for sliding movement therealong, a rotation member supported on the governor shaft and driven for rotation by the drive shaft, and fly weights supported on the rotation member, and the governor sleeve urging the lever means to be pivotally moved under the influence of a centrifugal force exerted on the fly weights by the rotation of the rotation member;

(i) a main timer mounted on the housing, the main timer adjusting the cam mechanism in accordance with the pressure of the pump chamber, so that the higher the pressure of the pump chamber is, the earlier the timing of fuel injection becomes; and (j) a load timer cooperating with the main timer so as to adject the fuel injection timing in accordance with a load of the engine, the load timer including the governor, the load timer further including a relief hole formed axially in the governor shaft, first communication passage means extending through a peripheral wall of the governor shaft surrounding the relief hole, and second communication passage means extending through a peripheral wall of the governor sleeve, the pressure within the pump chamber escaping to the relief via the first and second communication passage means, the condition of communication between the first and second communication passage means being changed when the governor sleeve is moved, so that the pressure of the pump chamber is changed to thereby cause the main timer to adjust the fuel injection timing, one of the first and second communication passage means having a pair of first and second control holes spaced from each other in the axial direction of the governor shaft, when governor sleeve is disposed at a forward position because of a low load, the other of the two communication passage means being prevented from communication with the second control hole, and being communicated with the first control hole in such a manner that the area of this communication is equal to the cross-sectional area of the first control hole, when the governor sleeve is disposed at a rearward position because of a high engine load, the other communication passage means being prevented from communication with the first control hole and being communicated with the second control hole in such a manner that the area of this communication is equal to the cross-sectional area of the second control hole, the stroke of movement of the governor sleeve between the forward position and the rearward position having a first movement region and a second movement region; in the first movement region, the area of communication between the first control hole and the other communication passage means decreasing as the governor sleeve is retracted; and in the second movement region, the area of communication between the second control hole and the other communication passage means increasing as the governor sleeve is retracted.

DESCRIPTION OF THE PREFERRED EMBODIMENTS

Figure 1:
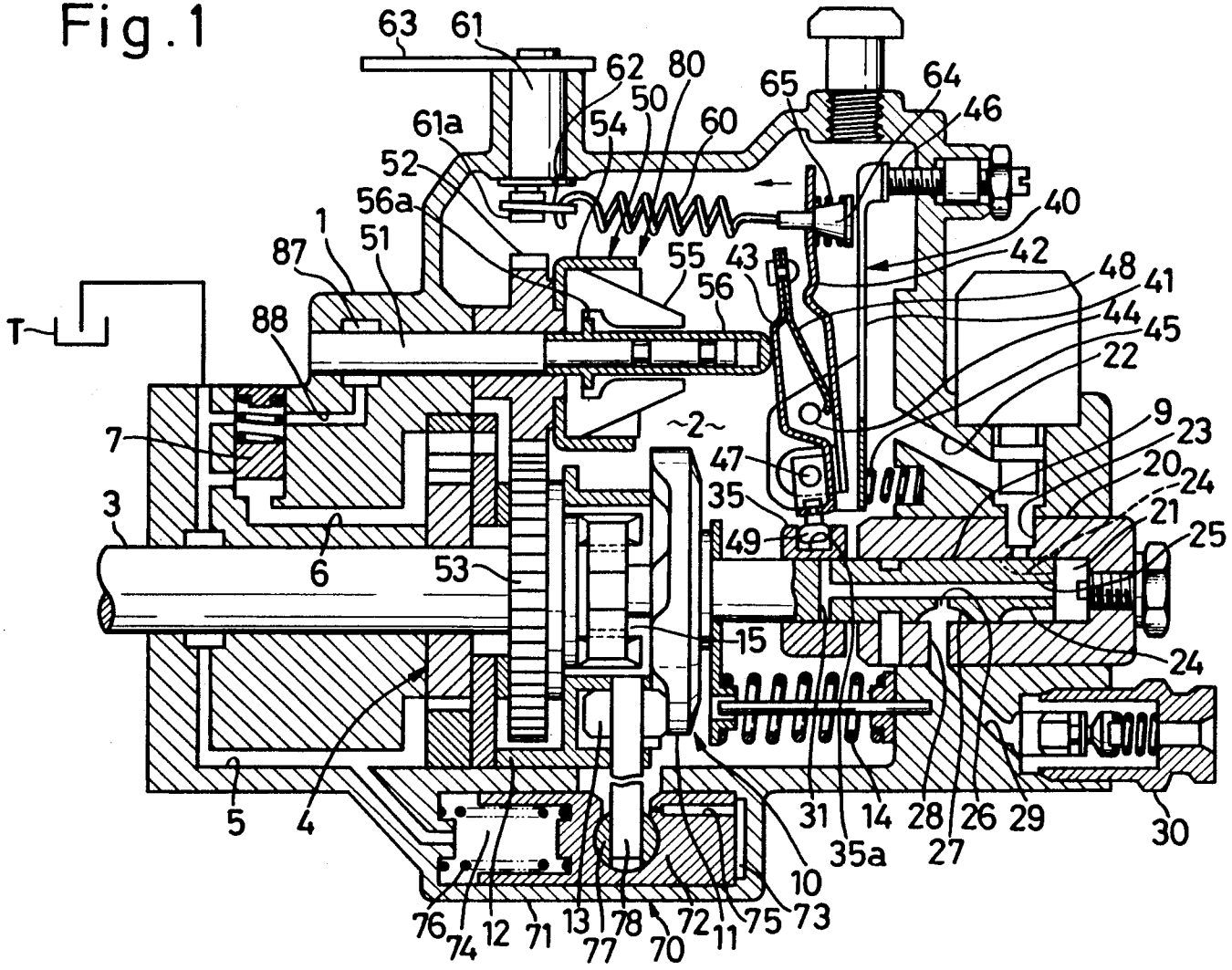
FIG. 1 is a cross-sectional view of a fuel injected pump of the distribution type.

The present invention will now be described with reference to the drawings. FIG. 1 shows an overall construction of a fuel injection pump of the distribution type. This pump comprises a housing 1, and an internal space of the housing 1 serves as a pump chamber 2. A drive shaft 3 driven for rotation by an engine extends through and is rotatably supported by a left portion (FIG. 1) of the housing 1. A feed pump 4 driven by the drive shaft 3 is accommodated within the housing 1. Fuel in a fuel tank T is drawn by the feed pump 4 into the pump chamber 2 via a low-pressure passage 5 formed in the housing 1. The discharge side of the feed pump 4 is communicated with the low-pressure passage 5 via a relief passage 6 formed in the housing 1. A regulating valve 7 is provided in the relief passage 6 so as to prevent the pressure of the pump chamber 2 from becoming excessive.

A left end of a plunger 9 is connected to the right end portion of the drive shaft 3 extending into the pump chamber 2. More specifically, the left end of the plunger 9 is fixedly secured to a cam disk 11 of a mechanism 10 (later described). The drive shaft 3 is connected via a coupler 15 to the cam disk 11 so as to rotate the cam disk 11 in a manner to allow an axial movement of the cam disk 11.

The plunger 9 is reciprocally moved by the cam mechanism 10 when the pluger 9 is rotated. The cam mechanism 10 comprises the cam disk 11, a ring-shaped roller holder 12 angularly movably supported on the housing 1, a plurality of rollers 13 (only one of which is shown in FIG. 1) rotatably supported by the roller holder 12, and a spring 14 urging the cam disk 11 against the rollers 13. When the cam disk 11 rotates relative to the rollers 13, the cam disk 11 is reciprocally moved axially, so that the plunger 9 is reciprocally moved axially in response to the reciprocal movement of the cam disk 11.

A barrel 20 extends through and is fixed to the right portion (FIG. 1) of the housing 1, and is disposed coaxially with the drive shaft 3. The barrel 20 serves as part of the housing 1. The right end portion of the plunger 9 is inserted into the barrel 20. A fuel pressurizing chamber 21 is formed by the right end of the plunger 9 and the barrel 20.

During the movement of the plunger 9 in the left direction, that is, during a suction stroke, the fuel in the pump chamber 2 is drawn to the fuel pressurizing chamber 21 via a fuel supply passage 22 formed in the housing 1, a port 23 formed in the barrel 20 and one of a plurality of inlet slits 24 formed in the outer peripheral surface of the right end portion of the plunger 9.

During the movement of the plunger 9 in the right direction, that is, during a pumping stroke, the pressurized fuel in the fuel pressurizing chamber 21 is fed to one of a plurality of delivery valves 30 mounted on the housing via an axial bore 25 in the plunger 9, a port 26 extending radially from the axial bore 25 intermediate the opposite ends of the axial bore 25, an outlet slit 27 formed in the outer peripheral surface of the plunger 9, one of a plurality of ports 28 formed radially in the barrel 20, and one of a plurality of fuel discharge passages 29 formed in the housing 1. The pressurized fuel is further fed from this delivery valve 30 via a pipe (not shown) to an injection nozzle mounted on the engine, and is injected there. Thus, the pressurized fuel is supplied sequentially to a plurality of injection nozzles.

The plunger 9 has a cut-off port 31 which extends radially from the left end of the axial bore 25 and is open to the outer peripheral surface of the plunger 9. A control sleeve 35 is fitted on the outer periphery of the plunger 9 so as to slidably move therealong. The control sleeve 35 closes the cut-off port 31 at the pumping stroke of the plunger 9. When the cut-off port 31 moves away from the control sleeve 35, the pressurized fuel in the fuel pressurizing chamber 21 is spilt to the pump chamber 2 via the axial bore 25 and the cut-off port 31, and the fuel injection is finished. Therefore, if the control sleeve 35 is displaced in the right direction, the stroke of movement of the plunger 9 from the start of the fuel injection to the end of the fuel injection is made longer, so that the amount of the fuel injection is increased. In contrast, if the control sleeve 25 is displaced in the left direction, the fuel injection amount is decreased.

The mechanism for adjusting the fuel injection amount by adjusting the position of the control sleeve 35 will now be described. A lever assembly 40 is mounted within the housing 1. The lever assembly 40 comprises a collector lever 41, a tension lever 42, and a start lever 43. The collector lever 41 is supported for pivotal movement about a pin 44. The collector lever 41 is urged at its lower end portion by a strong spring 45, so that its upper end portion is abutted against a screw 46. Therefore, the collector lever 41 is kept substantially stationary. The tension lever 42 and the start lever 43 are pivotally supported at their lower end portions on the lower end portion of the collector lever 41 by a pin 47. A weak start spring 48 is interposed between the upper portions of the tension lever 42 and the start lever 43 to urge them away from each other. An engagement member 49 is secured to the lower end of the start lever 43, and is received in a recess 35*a* formed in the outer peripheral surface of the control sleeve 35.

The lever assembly 40 receives angular movement moments which act in opposite directions and are applied respectively from a governor 50 and a governor spring 60 both of which are mounted within the housing 1.

The governor 50 includes a governor shaft 51 which extends into and is fixed to the housing 1, the governor shaft 50 extending parallel to the drive shaft 3. A gear 52 is rotatably mounted on the governor shaft 51, and in mesh with a gear 53 fixedly mounted on the drive shaft 3. A governor case (rotation member) 54 is fixedly secured to the gear 52, and fly weights 55 are received within the governor case 54 and are spaced from one another at equal intervals in the direction of the circumference of the governor case 54. A governor sleeve 56 is fitted on the outer periphery of the portion of the governor shaft 51 disposed within the pump chamber 2, so as to slidably move along the governor shaft 51. The distal end of the governor sleeve 56 is always held against the start lever 43 of the lever assembly 40. A flange 56*a* is formed on the outer periphery of the proximal end portion of the governor sleeve 56, and the proximal ends of the fly weights 55 are engaged with the flange 56*a*. When the governor case 54 rotates in response to the rotation of the drive shaft 3, the fly weights 55 are opened under the influence of a centrifugal force to urge the governor sleeve 56 to advance toward the lever assembly 40, thereby applying a clockwise angular movement moment to the start lever 43.

A shaft 61 rotatably extends through the upper portion of the housing 1, and a projection 61*a* is formed on the lower end of the shaft 61 in eccentric relation to the axis of rotation of the shaft 61. One end of the governor spring 60 is connected to the projection 61*a* through an engagement member 62. A control lever 63 is attached to the upper end of the shaft 61. An engagement member 64 is attached to the other end of the governor spring 60. The engagement member 64 extends through the upper end portion of the tension lever 42, and a weak idle spring 65 is interposed between the engagement member 64 and the tension lever 42.

The control lever 63 is angularly moved in accordance with the amount of pressing-down of an accelerator pedal (not shown), so that the governor spring 60 is pulled to apply a counterclockwise angular movement moment to the tension lever 42.

At the time of the start of the engine, the tension lever 42 is pivotally moved in a counterclockwise direction under the influence of the governor spring 60, and is abutted against a stopper (not shown). In this condition, the start lever 43 is pivotally moved counterclockwise under the influence of the start spring 48, so that the governor sleeve 56 is in a most retracted position. Therefore, the control sleeve 35 is disposed in the most rightward direction, and therefore the fuel injection amount is large.

As the engine speed increases from the time of start of the engine, the governor sleeve 56 is advanced by the centrifugal force of the fly weights 55 to pivotally move the start lever 43 clockwise against the bias of the weak start spring 48. As a result, the control sleeve 35 is moved in the left direction, and the upper end portion of the start lever 43 is abutted against the tension lever 42. Thereafter, the start lever 43 and the tension lever 42 are pivotally moved in unison, with their upper end portions held against each other.

At the time of the idling, the pivotal positions of the tension lever 42 and the start lever 43 (and hence the position of the control sleeve 35) are so determined that the counterclockwise angular movement moment applied to the tension lever 42 by the idle spring 65 is balanced with the clockwise angular movement moment applied to the start lever 43 by the advancing force of the governor sleeve 56. Since the idle spring 65 is weak, the control sleeve 35 is disposed in the most leftward position, and therefore the fuel injection amount is small.

In a normal operating condition of the engine, the pivotal positions of the tension lever 42 and the start lever 43 (and hence the position of the control sleeve 35) are so determined that the counterclockwise angular movement moment applied to the tension lever 42 by the governor spring 60 is balanced with the clockwise angular movement moment applied to the start lever 43 by the advancing force of the governor sleeve 56. The more the accelerator pedal is pressed down (that is, the greater the amount of pivotal movement of the control lever 63 is to increase the pulling force of the governor spring 60), the more the control sleeve 35 is moved rightward (that is, in the direction of the pumping stroke of the plunger 9), thereby increasing the fuel injection amount. The higher the engine speed is (that is, the greater the advancing force of the governor sleeve 56 is), the more the control speed 35 is moved leftward (that is, in the direction of the suction stroke of the plunger 9), thereby decreasing the fuel injection amount.

The above operation can be discussed as follows. When the engine load is increased, the fuel injection amount is increased, and when the engine load is decreased, the fuel injection amount is decreased. The position of the governor sleeve 56 corresponds to the fuel injection amount, and therefore corresponds to the engine load.

Next, the mechanism for adjusting the fuel injection timing will now be described. As shown in FIG. 1, a main timer 70 is provided on the lower portion of the housing 1. Although the main timer 70 is actually disposed perpendicular to the sheet of FIG. 1, it is shown parallel to this sheet for better understanding of the construction. The main timer 70 comprises a cylinder portion 71 formed on the lower portion of the housing 1, and a piston 72 slidably received in the cylinder portion 71. The cylinder portion 71 has a high-pressure chamber 73 and a low-pressure chamber 74 partitioned from each other by the piston 72. The high-pressure chamber 73 is communicated with the pump chamber 2 via a passage 75 formed in the piston 72. The piston 72 is urged toward the low-pressure chamber 74 by the pressure of the high-pressure chamber 73 (that is, the pressure of the pump chamber 2). A spring 76 for urging the piston 72 toward the high-pressure chamber 73 is received in the low-pressure chamber 74. The piston 72 is positioned in such a manner that the urging force of the spring 76 is balanced with the pressure of the high-pressure chamber 73. A piece 77 is rotatably fitted in the central portion of the piston 72. The piece 77 is connected to the roller holder 12 via a rod 78.

The pressure of the high-pressure chamber 73 of the main timer 70 (that is, the pressure of the pump chamber 2) increases with the increase of the rotational speed of the feed pump 4 (that is, the engine speed). When the piston 72 moves toward the low-pressure chamber 74 accordance with the increase of the pressure of the high-pressure chamber 73, the roller holder 12 is angularly displaced in a direction opposite to the direction of rotation of the cam disk 11. Therefore, the fuel injection timing is rendered early or advanced. In contrast, when the timer piston 72 is moved toward the high-pressure chamber 73 in accordance with the decrease of the pressure of the high-pressure chamber 73, the roller holder 12 is angularly displaced in the same direction as the direction of rotation of the cam disk 11. Therefore, the fuel injection timing is rendered late or delayed.

Figure 2A:
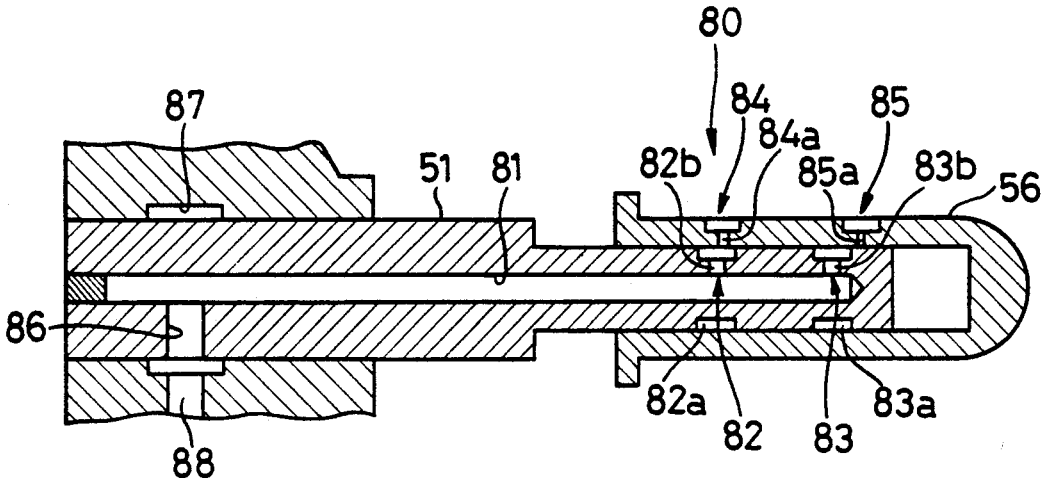
FIGS. 2A to 2C are cross-sectional views of a load timer, showing its operation sequentially from a low-load condition to a high-load condition.

With the provision of the main timer 70 only, the fuel injection timing can be adjusted only in accordance wih the engine speed. By providing a load timer 80 cooperating with the main timer 70, fuel injection timing can be adjusted in accordance with the engine load. The load timer 80 includes the governor 50, and as best shown in FIG. 2A, the load timer 80 also includes a relief hole 81 formed in the governor shaft 51 and extending axially thereof, a pair of communication passages 82 and 83 formed the peripheral wall of the governor shaft 51 and spaced from each other along the axis of the governor shaft 51, and a pair of communication passages 84 and 85 formed through the peripheral wall of the governor sleeve 56 and spaced form each other along the axis of the governor sleeve 56. For the sake of simplicity of the illustration, the communication passages 82 to 85 are not shown in FIG. 1.

The proximal end of the relief hole 81 is communicated with the low-pressure passage 5 via a hole 86 formed radially through the peripheral wall of the governor shaft 51, an annular groove 87 formed in the inner peripheral surface of the hole (which supports the governor shaft 51) formed in the housing 1, and a passage 88 formed in the housing 1. Therefore, the proximal end of the relief hole 81 is communicated with the tank T and the suction side of the feed pump 4.

The communication passages 82 and 83 constitute first communication passage means. Each of the communication passages 82 and 83 has an annular groove 82*a* (83*a*) formed in the outer peripheral surface of the governor shaft 51, and a radially-extending port 82*b* (83*b*) communicating the annular groove 82*a* (83*a*) with the relief hole 81.

The communication passages 84 and 85 constitute second communication passage means. Each of the communication passages 84 and 85 is formed by a stepped through hole of a circular cross-section, and its smaller-diameter portion serves as a control hole 84*a* (85*a*). Hereinafter, the rear control hole 84*a* will be referred to as "first control hole", and the front control hole 85*a* will be referred to as "second control hole". The cross-sectional area of the first control hole 84*a* is greater than that of the second hole 85*a*. The cross-sectional area of the first control hole 84*a* is smaller than the cross-sectional areas of the ports 82*a* and 83*b*.

The operation of the load timer 80 of the above construction will now be described. For better understanding, the following discussion will be made assuming that the engine speed is constant. When the governor sleeve 56 is moved in accordance with the engine load, the condition of communication between the first communication passage means of the governor shaft 51 and the second communication passage means of the governor sleeve 56 is changed to change the amount of relief of the fuel in the pump chamber 2, so that the pressure of the pump chamber 2 is changed. In accordance with this change of the pressure of the pump chamber 2, the main timer 70 adjusts the roller holder 12 of the cam mechanism 10, thereby adjusting the fuel injection timing.

Figure 3:
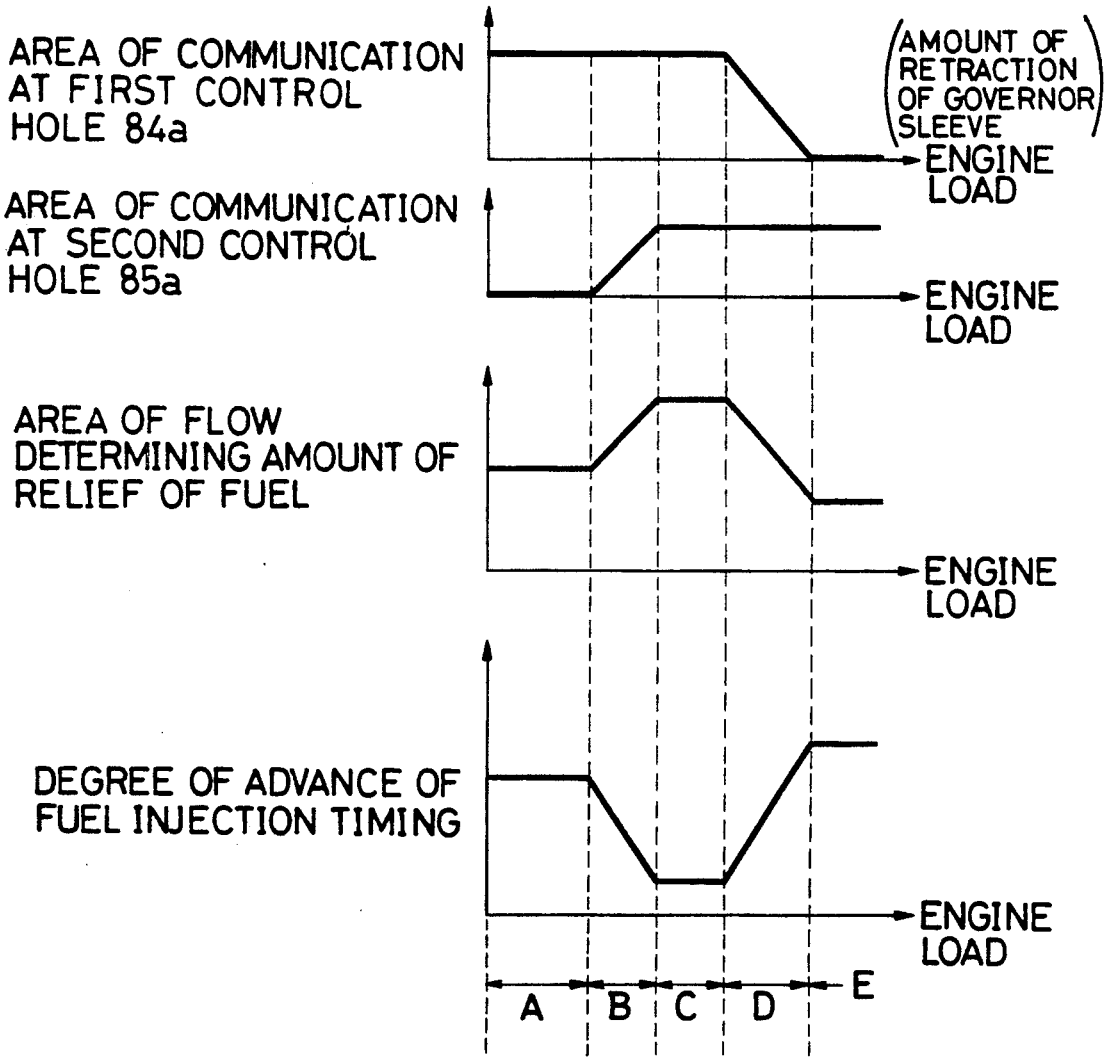
FIG. 3 is a diagrammatical illustration showing the characteristics of the load timer.

When the engine load is low, so that the governor sleeve 56 is in an advanced position as shown in FIG. 2A (that is, the governor sleeve 56 is at a movement region A of its movement stroke in FIG. 3), the communication between the second control hole 85*a* and the front annular groove 83*a* is interrupted, and the first control hole 84*a* is fully opened and communicated with the rear annular groove 82*a*. Therefore, the fuel in the pump chamber 2 escapes to the relief hole 81 only via the rear communication passages 84 and 82. Thus, the area of flow which determines the amount of relief of the fuel is equal to the cross-sectional area of the first control hole 84*a*, and is small, and therefore the fuel injection timing can be relatively advanced.

As the engine load increases gradually, the governor sleeve 56 is retracted. When the governor sleeve 56 is disposed at a movement region B of the movement stroke in FIG. 3, the area of communication between the second control hole 85*a* and the front annular groove 83*a* (that is, the area surrounded by the peripheral edge of the inner end of the second control hole 85*a* and the front edge of the annular groove 83*a*) increases with the increase of the engine load. At this time, the area of communication between the first control hole 84*a* and the rear annular groove 82*a* is not changed, and therefore the area of flow which determines the amount of relief of the fuel is increased. As a result, the pressure of the pump chamber 2 decreases with the increase of the engine load, and the fuel injection timing is gradually delayed.

Figure 2B:
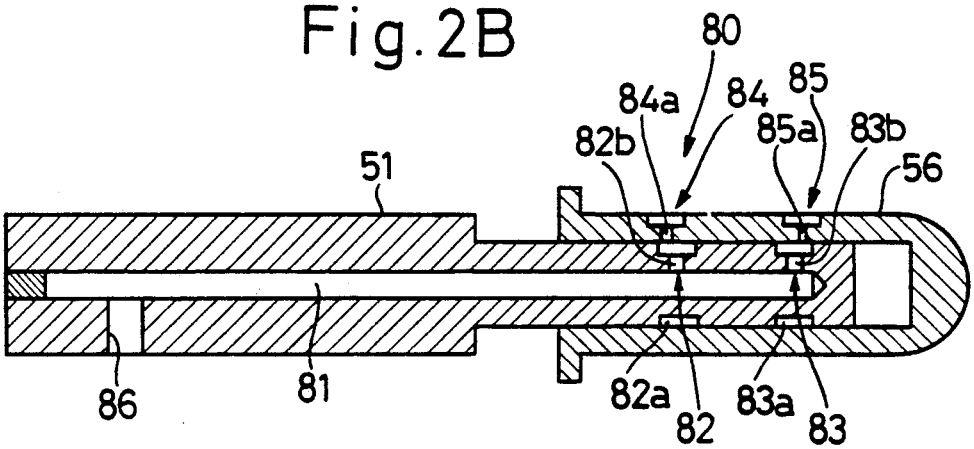

When the engine load is further increased, so that the governor sleeve 56 is disposed at a position shown in FIG. 2B (that is, at a movement region C of its movement stroke in FIG. 3), the first and second control holes 84*a* and 85*a* are fully opened and communicated with the annular grooves 82 and 83, respectively, and the area of flow determining the amount of relief of the fuel is equal to the sum of the cross-sectional areas of the control holes 84*a* and 85*a*, and is the maximum. As a result, the fuel injection timing is the latest.

When the engine load is further increased, so that the governor sleeve 56 is disposed at a movement region D of its movement stroke in FIG. 3, the area of communication between the first control hole 84*a* and the rear annular groove 82*a* (that is, the area surrounded by the peripheral edge of the inner end of the first control hole 84*a* and the rear edge of the annular groove 82*a*) decreases with the increase of the engine load. At this time, the area of communication between the second control hole 85*a* and the front annular hole 83*a* is not charged, and therefore the area of flow determining the amount of relief of the fuel is decreased. As a result, the pressure of the pump chamber 2 increases with the increase of the engine load, and therefore the fuel injection timing is gradually advanced.

Figure 2C:
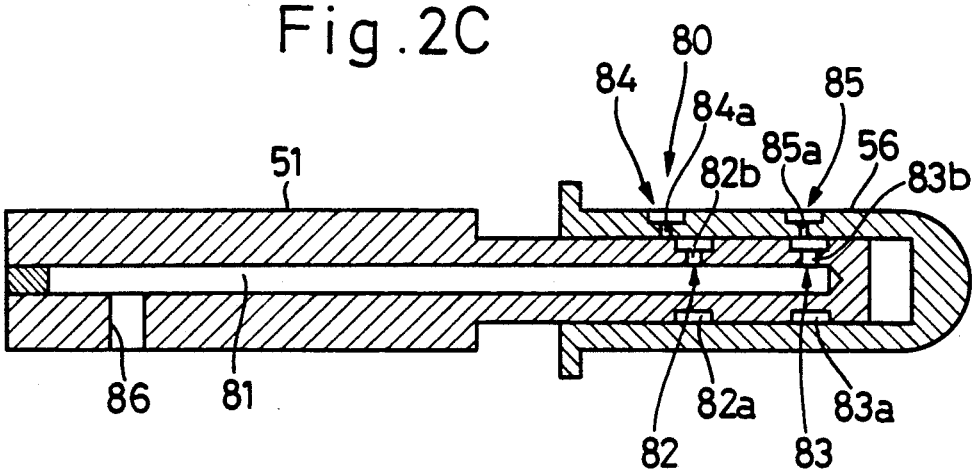

When the engine load is further increased, so that the governor sleeve 56 is disposed at a position shown in FIG. 2C (that is, at a movement region E of its movement stroke in FIG. 3), the communication between the first control hole 84*a* and the rear annular groove 82*a* is interrupted, and the second control hole 85*a* is fully opened and communicated with the front annular groove 83*a*. Therefore, the fuel in the pump chamber 2 escapes to the relief hole 81 only via the front communication passages 85 and 83. The area of flow determining the amount of relief of the fuel is equal to the cross-sectional area of the second control hole 85*a*, and is smaller than the cross-sectional area of the first control hole 84*a*, and therefore the fuel injection timing can be made the earkiest.

In this embodiment, the fuel injection timing is advanced as the engine load increases from the medium load region, and therefore the generation of smoke can be prevented. Also, the fuel injection timing is advanced as the engine load decreases from the medium load region, and therefore in the low-load operating condition soon after the start of the engine at a high place or at a low temperature, the stop of the engine and the generation of smoke can be prevented.

Modified forms of load timers will be described with reference to the drawings. Those parts of these embodiments corresponding respectively to those of the preceding embodiment are designated by identical reference numerals, respectively, and explanation thereof will be omitted.

Figure 4A:
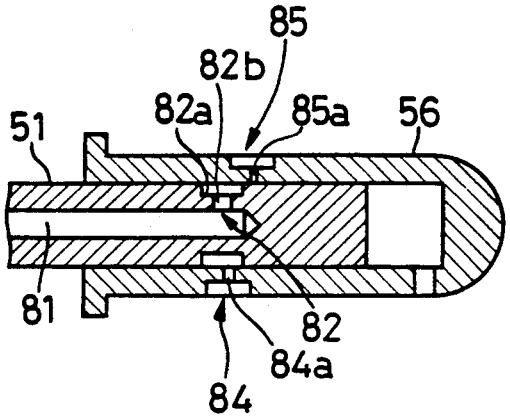
FIGS. 4A to 4C are views similar to FIGS. 2A to 2C, but showing a modified load timer.
Figure 4B:
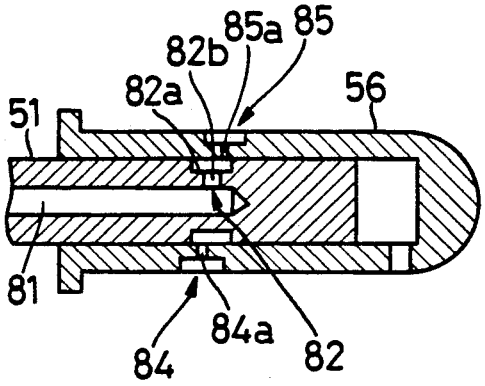
Figure 4C:
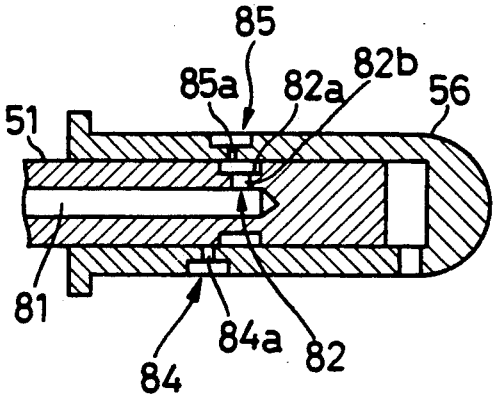

In a load timer shown in FIGS. 4A to 4C, only one communications passage 82 is formed in a governor shaft 51. A governor sleeve 56 has communication passages 84 and 85 which are spaced from each other both circumferentially and axially of the governor sleeve 56. When the engine load is low, so that the governor sleeve 56 is disposed at an advanced position, a front second control hole 85*a* is closed, and a first control hole 84*a* is communicated with an annular groove 82*a* of the communication passage 82, as shown in FIG. 4A. When the engine load is at a medium load region, the first control hole 84*a* and the second control hole 85*a* are fully opened, and are communicated with the annular groove 82*a*, as shown in FIG. 4B. When the engine load is high, the first control hole 84*a* is closed, and the second control hole 85*a* is communicated with the annular groove 82*a*, as shown in FIG. 4C. When the governor sleeve 56 is positioned at a movement region of its movement stroke intermediate the position of FIG. 4A and the position of FIG. 4B, the area of communication between the second control hole 85*a* and the annular groove 82*a* is determined by the peripheral edge of the inner end of the second control hole 85*a* and the front edge of the annular groove 82*a*. When the governor sleeve 56 is positioned at a movement region of its movement stroke intermediate the position of FIG. 4B and the position of FIG. 4C, the area of communication between the first control hole 84*a* and the annular groove 82*a* is determined by the peripheral edge of the inner end of the first control hole 84*a* and the rear edge of the annular groove 82*a*. Therefore, this load timer has the characteristics of FIG. 3.

Figure 5A:
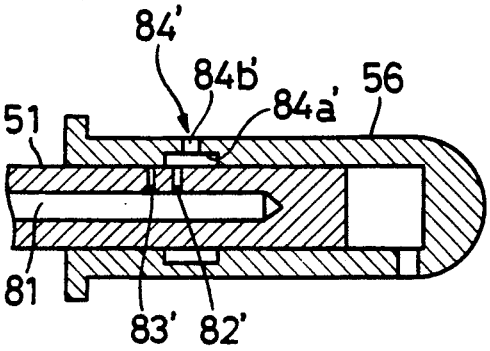
FIGS 5A to 5C are views similar to FIGS. 2A to 2C, but showing another modified load timer.
Figure 5B:
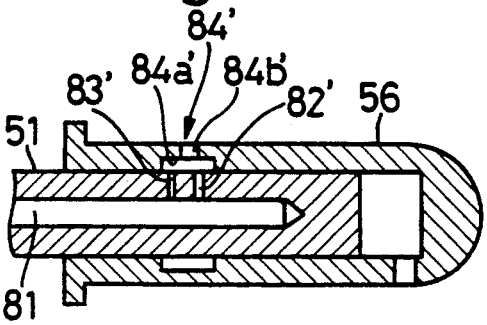
Figure 5C:
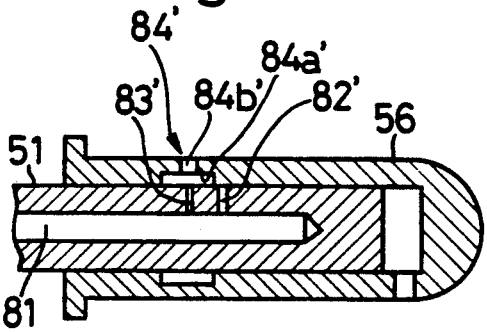

In a load timer shown in FIGS. 5A to 5C, in contrast with the load timer shown in FIGS. 4A to 4C, a governor shaft 51 has a pair of first and second control holes 82' and 83' of a circular cross-section spaced from each other axially of the governor shaft 51. A governor sleeve 56 has one communication passage 84'. The communication passage 84' has an annular groove 84*a'* formed in the inner peripheral surface of the governor sleeve 56, and a port 84*b'* communicating the annular groove 84*a'* with a pump chamber. The first control hole 82' is disposed forwardly of the second control hole 83'. The cross-sectional area of the first control hole 82' is greater than that of the second control hole 83'. The cross-sectional area of the first control hole 82' is smaller than that of the port 84*b'*. In this load timer, when the engine load is low, so that the governor sleeve 56 is disposed at an advanced position, the rear second control hole 83' is closed, and the front first control hole 82' is fully opened and is communicated with the annular groove 84*a'*, as shown in FIG. 5A. When the engine load is at a medium region, the first control hole 82' and the second control hole 83' are fully opened and communicated with the annular groove 84*a'*, as shown in FIG. 5B. When the engine load is high, the first control hole 82' is closed, and the second control hole 83' is fully opened and is communicated with the annular groove 84*a'*, as shown in FIG. 5C. When the governor sleeve 56 is positioned at a movment region of its movement stroke intermediate between the position of FIG. 5A and the position of FIG. 5B, the area of communication between the second control hole 83' and the annular groove 84*a'* is determined by the peripheral edge of the inner end of the second control hole 83' and the rear edge of the annular groove 84*a'*. When the governor sleeve 56 is positioned at a movement region of its movement stroke intermediate the position of FIG. 5B and the position of FIG. 5C, the area of communication between the first control hole 82' and the annular groove 84*a'* is determined by the peripheral edge of the inner end of the first control hole 82' and the front edge of the annular groove 84*a'*. Therefore, this load timer also has the characteristics of FIG. 3.

Modified load timers described below are analogous to the load timer of FIGS. 4A to 4C, but have various characteristics obtained by varying the position and shape of control holes.

Figure 6:
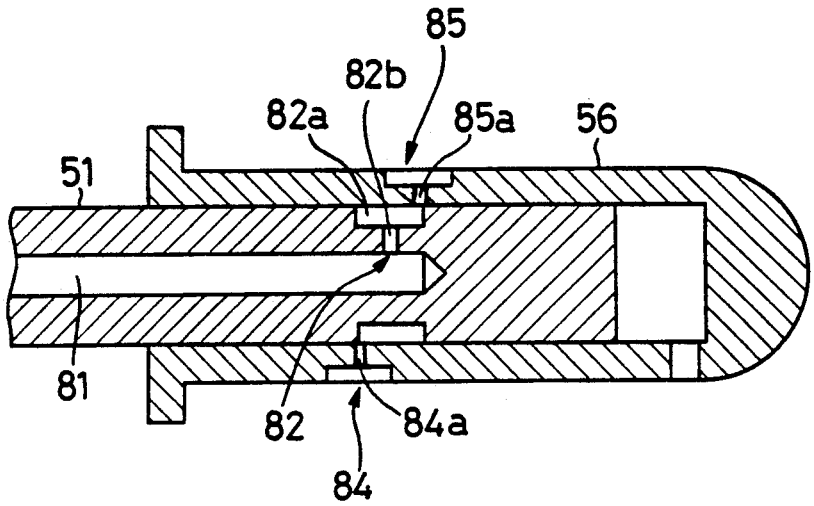
FIG. 6 is a cross-sectional view of a further modified load timer.
Figure 7:
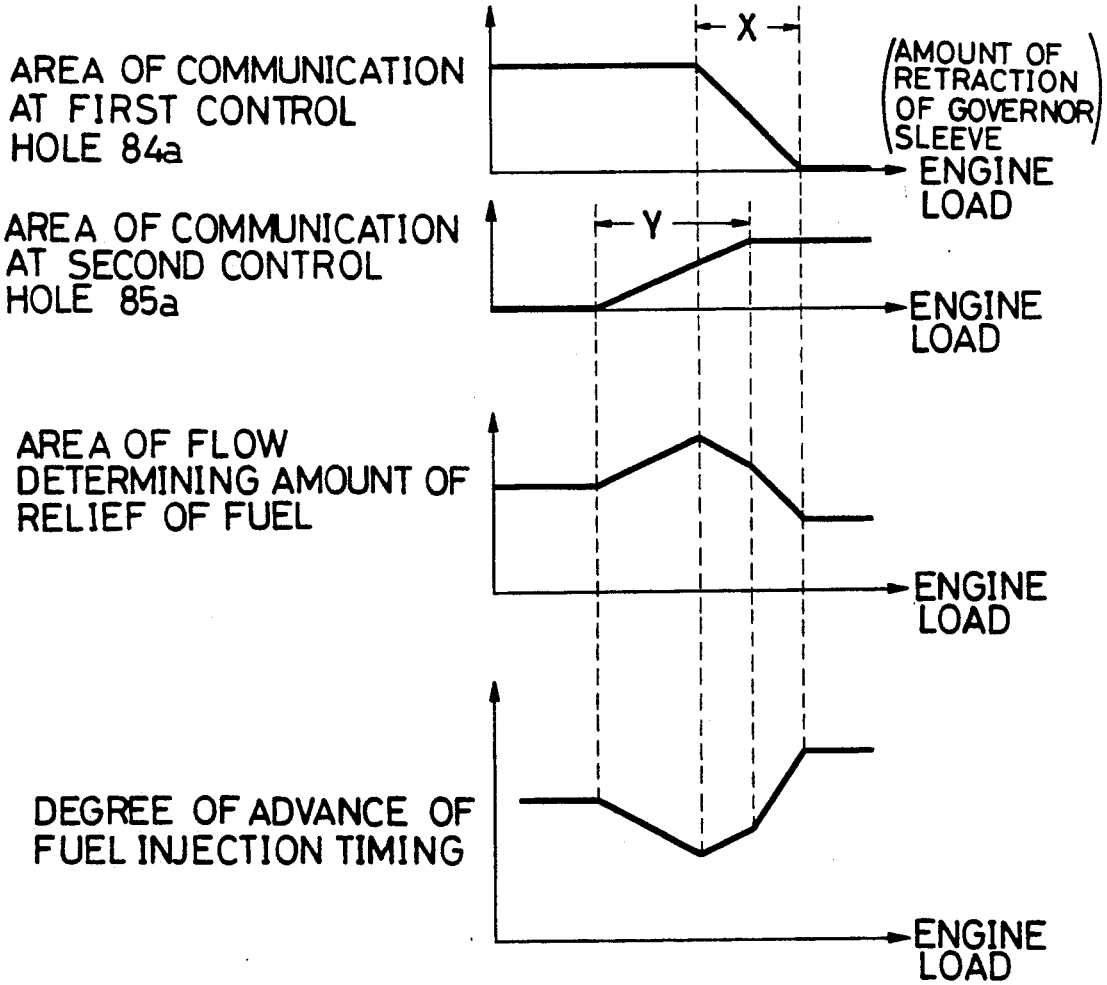
FIG. 7 is a diagrammatical illustration showing the characteristics of the load timer of FIG. 6.

In a load timer shown in FIG. 6, when a governor sleeve 56 is in a position shown in FIG. 6, first and second control holes 84*a* and 85*a* are partially communicated with an annular groove 82*a*. However, there is no movement region of the movement stroke of the governor sleeve 56 where both of the control holes 84*a* and 85*a* are communicated with the annular groove 82*a* in a fully opened condition. The second control hole 85*a* is defined by a slot extending axially of the governor sleeve 56, and the cross-sectional area of the second control hole 85*a* is smaller than that of the first control hole 84*a*. The characteristics of the load timer of FIG. 6 are shown in FIG. 7. As is clear from FIG. 7, the stroke of movement of the governor sleeve 56 has a movement region Y where the area of communication between the second control hole 85*a* and the annular groove 82*a* increases with the increase of the engine load. This movement stroke also has a movement region X where the area of communication between the first control hole 84*a* and the annular groove 82*a* decreases with the increase of the engine load. The movement regions X and Y partially overlap each other. As a result, the characteristics of the degree of advance of the fuel injection timing relative to the engine load are somewhat different from those of the above embodiments. More specifically, the gradient of the degree of advance of the fuel injection timing varies as the engine load increases from a certain value.

Figure 8:
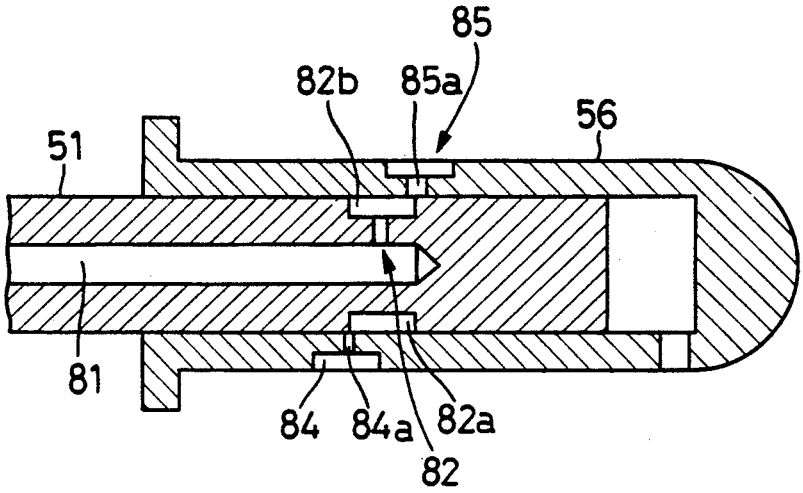
FIG. 8 is a cross-sectional view of a further modified load timer.
Figure 9:
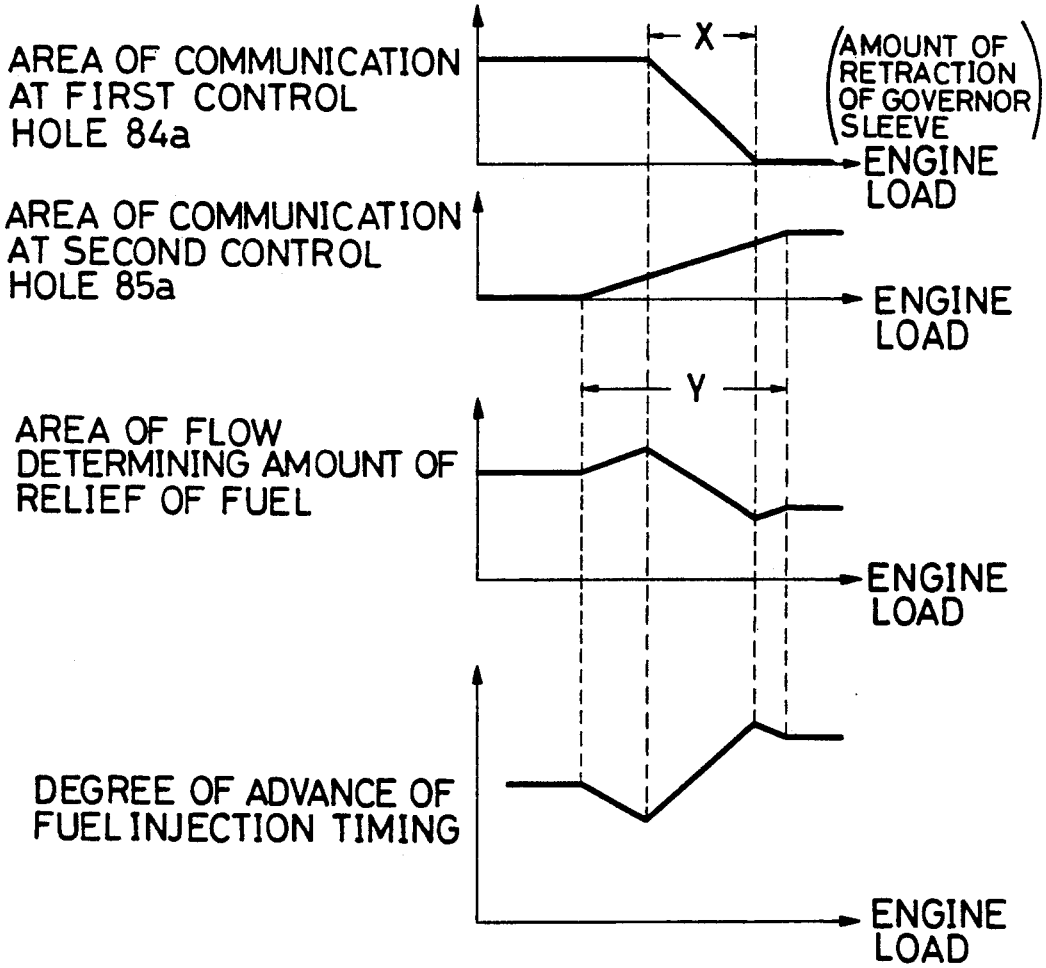
FIG. 9 is a diagrammatical illustration showing the characteristics of the load timer of FIG. 8.

A load timer shown in FIGS. 8 and 9 is analogous to the load timer of FIGS. 6 and 7. The stroke of movement of a governor sleeve 56 has a movement region Y where the area of communication between a second control hole 85*a* and an annular groove 82*a* iqcreases with the increase of the engine load. This movement stroke also has a movement region X where the area of communication between a first control hole 84*a* and the annular groove 82*a* decreases with the increase of the engine load. The whole of the movement region X overlaps part of the movement region Y. As a result, with respect to the characteristics of the degree of advance of the fuel injection timing relative to the engine load, as the engine load increases, the fuel injection timing is delayed, and then is advanced, and then again is delayed.

Figure 10:
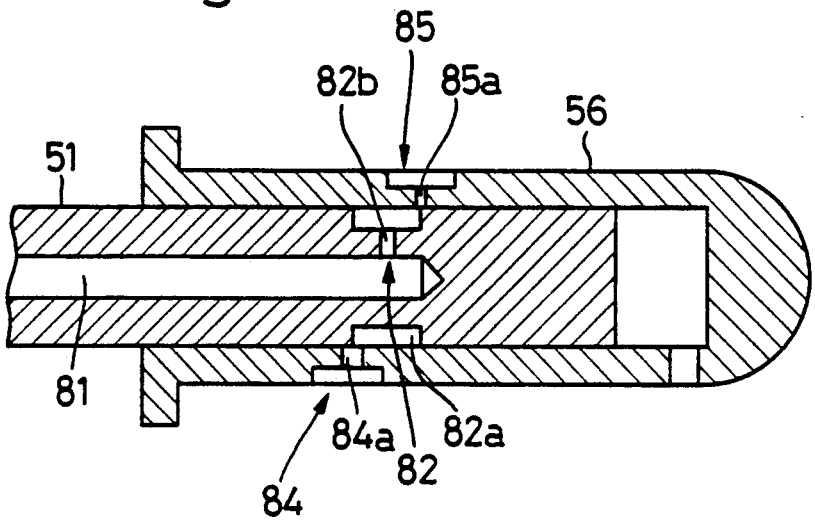
FIG. 10 is a cross-sectional view of a further modified load timer.
Figure 11:
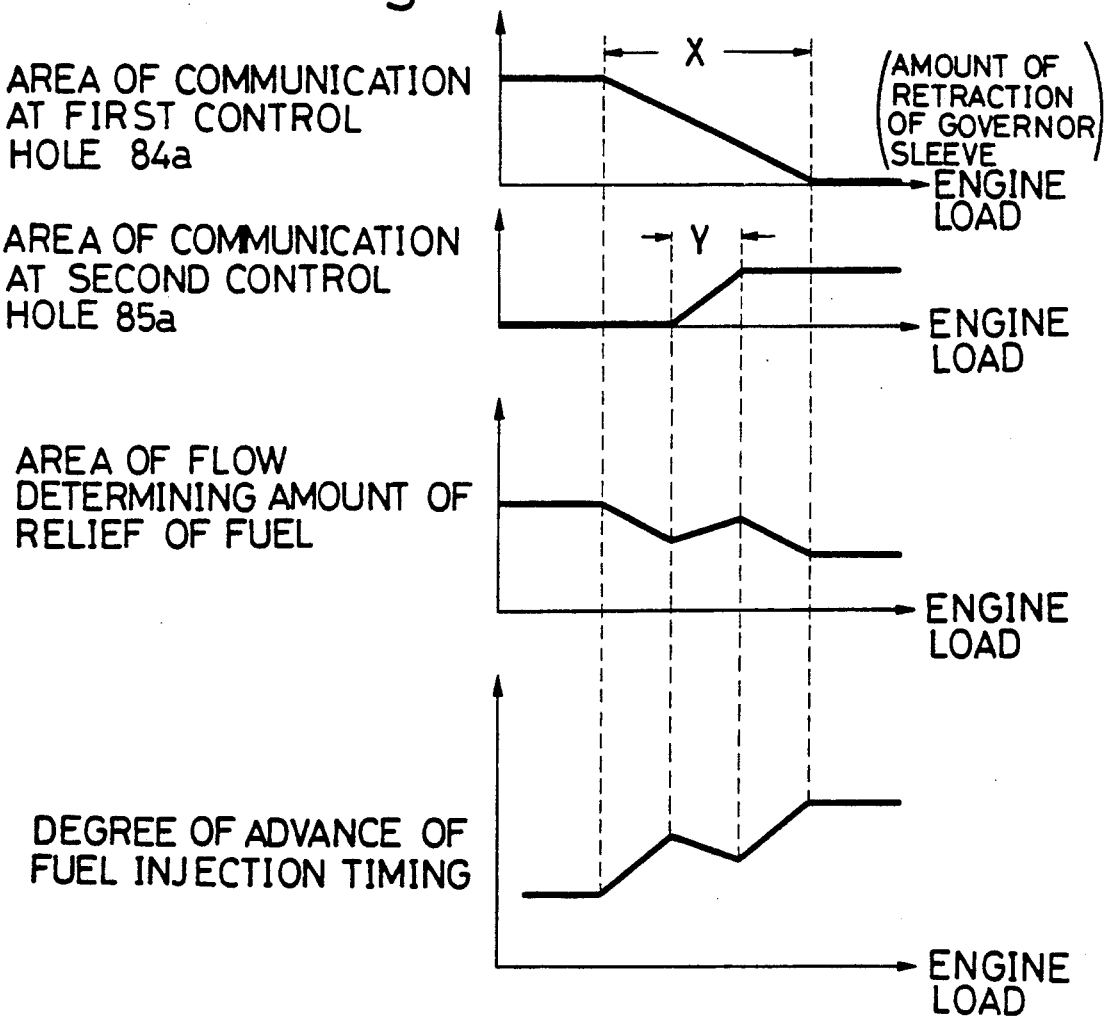
FIG. 11 is a diagrammatical illustration showing the characteristics of the load timer of FIG. 10.

In a load timer shown in FIGS. 10 and 11, a first control hole 84*a* is defined by a slot extending along a governor sleeve 56. The cross-sectional area of the first control hole 84*a* is greater than that of the second control hole 85*a* and is smaller than that of a port 82*b*. The stroke of movement of the governor sleeve 56 has a movement region X where the area of communication between the first control hole 84*a* and an annular groove 82*a* decreases with the increase of the engine load. This movement stoke also has a movement region Y where the area of communication between a second control hole 85*a* and the annular groove 82*a* increases with the increase of the engine load. The whole of the movement region Y overlaps part of the movement region X. As a result, with respect to the characteristics of the degree of advance of the fuel injection timing relative to the engine load, as the engine load increases, the fuel injection timing is advanced, and then is delayed, and then is again advanced.

Figure 12:
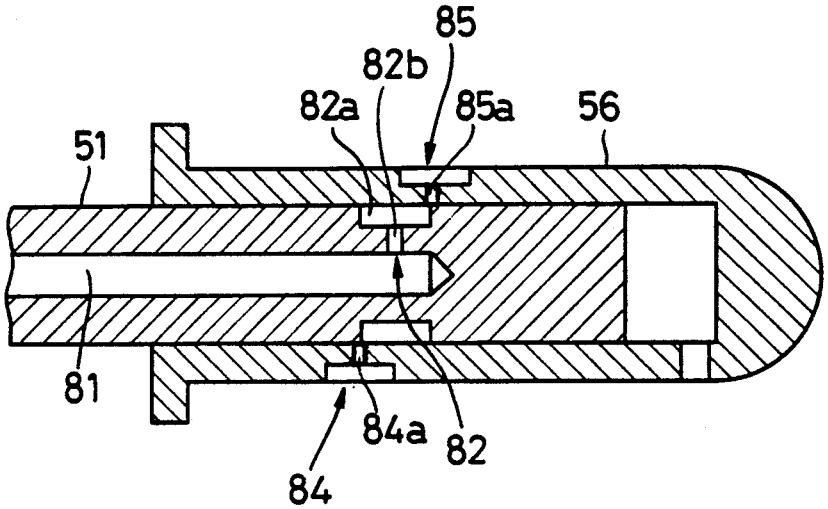
FIG. 12 is a cross-sectional view of a further modified load timer.
Figure 13:
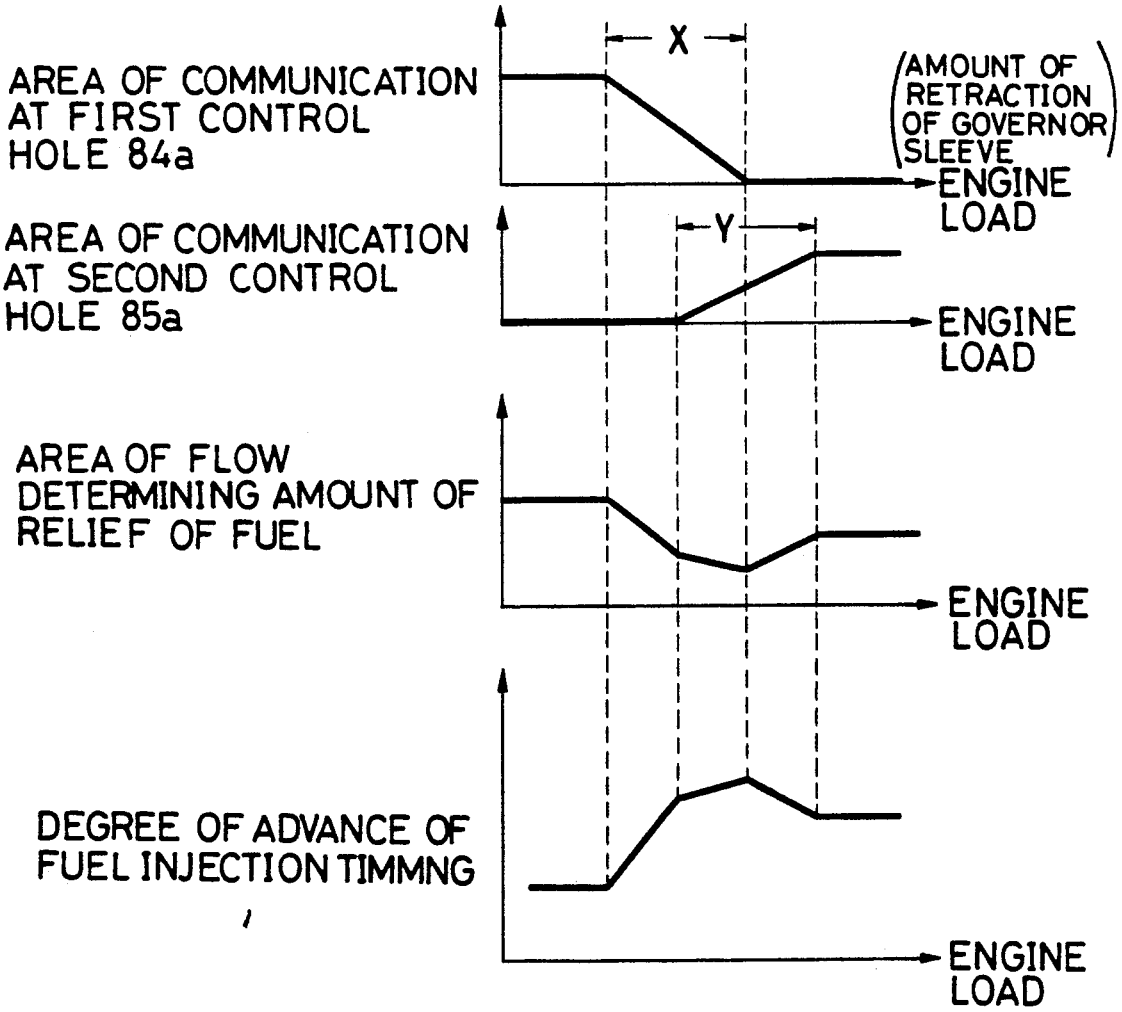
FIG. 13 is a diagrammatical illustration showing the characteristics of the load timer of FIG. 12.

A load timer shown in FIGS. 12 and 13 is analogous to the load timer of FIGS. 6 and 7 in that a second control hole 85*a* is defined by a slit and that first and second control holes 84*a* and 85*a* are partially communicated with an annular groove 82*a*, but differs therefrom in that the distance between the first control hole 84*a* and the second control hole 85*a* is greater than that in FIG. 6. In this embodiment, as is clear from FIG. 13, the stroke of movement of a governor sleeve 56 has a movement region X where the area of communication between the first control hole 84*a* and an annular groove 82*a* decreases with the increase of the engine load. This movement stroke also has a movement region Y where the area of communication between the second control hole 85*a* and the annular groove 82*a* increases with the increase of the engine load. The governor sleeve 56 is disposed at a more advanced position in the movement region X than in the movement region Y. The movement regions X and Y overlap each other. As a result, with respect to the characteristics of the degree of advance of the fuel injection timing relative to the engine load, as the engine load increases from a certain low value, the fuel injection timing is advanced with its gradient varied, and then is delayed.

The present invention is not limited to the above embodiments, and various modifications can be made. For example, the shape of the control holes may be square or triangular.

What is claimed is:

1. A fuel injection pump of the distribution type comprising:

(a) a housing whose internal space serves as a pump chamber;

(b) a drive shaft extending into said housing and being rotatable in response to rotation of an engine, one end of said drive shaft being disposed within said housing;

(c) a plunger disposed coaxially with said drive shaft, said drive shaft being connected at the one end thereof via a coupling to one end of said plunger so as to rotate said plunger in a manner to allow an axial movement of said plunger, the other end of said plunger cooperating with said housing to form a fuel pressurizing chamber, and said plunger having a cut-off port which is communicated with said fuel pressurizing chamber and is open to an outer peripheral surface of said plunger;

(d) a cam mechanism operable in response to the rotation of said plunger so as to cause said plunger to perform a suction stroke for drawing fuel into said fuel pressurizing chamber and to cause said plunger to perform a pumping stroke for pressurizing the fuel in said fuel pressurizing chamber;

(e) a control sleeve mounted on the outer periphery of said plunger for sliding movement therealong, said cut-off port in said plunger being closed by said control sleeve during the pumping stroke, when said cut-off port is moved away from said control sleeve, the pressurized fuel in said fuel pressurizing chamber escaping to said pump chamber, thereby finishing a fuel injection, and the position of said control sleeve determining the amount of injection of the fuel;

(f) lever means pivotally mounted within said housing so as to adjust the position of said control sleeve;

(g) a governor spring mounted within said housing so as to receive an acceleration force, said governor spring urging said lever means to be pivotally moved so as to move said control sleeve in a direction of the pumping stroke of said plunger;

(h) a governor urging said lever means to be pivotally moved so as to move said control sleeve in a direction of the suction stroke of said plunger, said governor including a governor shaft fixedly mounted on said housing and extending into said pump chamber, a governor sleeve mounted on an outer periphery of said governor shaft for sliding movement therealong, a rotation member supported on said governor shaft and driven for rotation by said drive shaft, and fly weights supported on said rotation member, and said governor sleeve urging said lever means to be pivotally moved under the influence of a centrifugal force exerted on said fly weights by the rotation of said rotation member;

(i) a main timer mounted on said housing, said main timer adjusting said cam mechanism in accordance with the pressure of said pump chamber, so that the higher the pressure of said pump chamber is, the earlier the timing of fuel injection becomes; and (j) a load timer cooperating with said main timer so as to adjust the fuel injection timing in accordance with a load of the engine, said load timer including said governor, said load timer further including a relief hole formed axially in said governor shaft, first communication passage means extending through a peripheral wall of said governor shaft surrounding said relief hole, and second communication passage means extending through a peripheral wall of said governor sleeve, the pressure within said pump chamber escaping to said relief hole via said first and second communication passage means, the condition of communication between said first and second communication passage means being changed when said governor sleeve is moved, so that the pressure of said pump chamber is changed to thereby cause said main timer to adjust the fuel injection timing, one of said first and second communication passage means having a pair of first and second control holes spaced from each other in the axial direction of said governor shaft, when said governor sleeve is disposed at a forward position because of a low engine load, the other of said two communication passage means being prevented from communication with said second control hole, and being communicated with said first control hole in such a manner that the area of this communication is equal to the cross-sectional area of said first control hole, when said governor sleeve is disposed at a rearward position because of a high engine load, said other communication passage means being prevented from communication with said first control hole and being communicated with said second control hole in such a manner that the area of this communication is equal to the cross-sectional area of said second control hole, the stroke of movement of said governor sleeve between said forward position and said rearward position having a first movement region and a second movement region; in said first movement region, the area of communication between said first control hole and said other communication passage means decreasing as said governor sleeve is retracted; and in said second movement region, the area of communication between said second control hole and said other communication passage means increasing as said governor sleeve is retracted.

2. A fuel injection pump according to claim 1, in which the cross-sectional area of said second control hole is smaller than that of said first control hole, so that the fuel injection timing is earlier at a high load of the engine than at a low load of the engine.

3. A fuel injection pump according to claim 1, in which said governor sleeve is disposed more rearwardly at said first movement region than at said second movement region.

4. A fuel injection pump according to claim 3, in which said stroke of movement of said governor sleeve has a third movement region, said governor sleeve being disposed more rearwardly at said third movement region than at said second movement region, and being disposed more forwardly at said third movement region than at said first movement region, and when said governor sleeve is at said third movement region, said other communication passage means being communicated with said first and second control holes in such a manner that the total area of this communication is equal to the sum of the cross-sectional areas of said first and second control holes.

5. A fuel injection pump according to claim 1, in which said governor sleeve is disposed more forwardly at said first movement region than at said second movement region.

6. A fuel injection pump according to claim 3 or claim 5, in which said first and second movement regions partially overlap each other.

7. A fuel injection pump according to claim 1, in which the whole of one of said first and second movement regions overlaps part of the other.

8. A fuel injection pump according to claim 1, in which said second communication passage means of said governor sleeve has said first and second control holes, said first control hole being disposed rearwardly of said second control hole.

9. A fuel injection pump according to claim 8, in which said first communication passage means of said governor shaft has a pair of annular grooves formed in the outer periphery of said governor shaft and spaced from each other axially of said governor shaft, when said governor sleeve is disposed at said first movement region, the area of communication between said first control hole and said rear annular groove being determined by a peripheral edge of an inner end of said first control hole and a rear edge of said rear annular groove, and when said governor sleeve is disposed at said second movement region, the area of communication between said second control hole and said front annular groove being determined by a peripheral edge of an inner end of said second control hole and a front edge of said front annular groove.

10. A fuel injection pump according to claim 8, in which said first communication passage means has a single annular groove formed in the outer periphery of said governor shaft, when said governor sleeve is disposed at said first movement region, the area of communication between said first control hole and said annular groove being determined by a peripheral edge of an inner end of said first control hole and a rear edge of said annular groove, and when said governor sleeve is disposed at said second movement region, the area of communication between said second control hole and said annular groove being determined by a peripheral edge of an inner end of said second control hole and a front edge of said annular groove.

11. A fuel injection pump according to claim 1, in which said first communication passage means of said governor shaft has said first and second control holes, said first control hole being disposed forwardly of said second control hole.

12. A fuel injection pump according to claim 11, in which said second communication passage means of said governor sleeve has an annular groove formed in an inner periphery of said governor sleeve, when said governor sleeve is disposed at said first movement region, the area of communication between said first control hole and said annular groove being determined by a peripheral edge of an inner end of said first control hole and a front edge of said annular groove, and when said governor sleeve is disposed at said second movement region, the area of communication between said second control hole and said annular groove being determined by an peripheral edge of an inner end of said second control hole and a rear edge of said annular groove.

* * * * *